US008717249B2

(12) United States Patent
Noguchi et al.

(10) Patent No.: US 8,717,249 B2
(45) Date of Patent: May 6, 2014

(54) VARIABLE DIRECTIVITY ANTENNA APPARATUS INCLUDING PARASITIC ELEMENTS HAVING CUT PORTION OF RECTANGULAR SHAPE

(75) Inventors: Wataru Noguchi, Hyogo (JP); Hiroyuki Yurugi, Osaka (JP)

(73) Assignee: Panasonic Corporation, Osaka (JP)

( * ) Notice: Subject to any disclaimer, the term of this patent is extended or adjusted under 35 U.S.C. 154(b) by 186 days.

(21) Appl. No.: 13/387,830

(22) PCT Filed: Dec. 24, 2010

(86) PCT No.: PCT/JP2010/007488

§ 371 (c)(1),
(2), (4) Date: Jan. 30, 2012

(87) PCT Pub. No.: WO2011/080903

PCT Pub. Date: Jul. 7, 2011

(65) Prior Publication Data

US 2012/0127053 A1 May 24, 2012

(30) Foreign Application Priority Data

Dec. 28, 2009 (JP) ..... 2009-296847

(51) Int. Cl.
*H01Q 3/24* (2006.01)
*H01Q 19/10* (2006.01)

(52) U.S. Cl.
USPC ..... 343/876; 343/833; 343/834

(58) Field of Classification Search
None
See application file for complete search history.

(56) References Cited

U.S. PATENT DOCUMENTS

| | | | | |
|---|---|---|---|---|
| 6,876,331 | B2 * | 4/2005 | Chiang et al. | 343/702 |
| 6,946,997 | B2 | 9/2005 | Yuanzhu | |
| 6,987,493 | B2 * | 1/2006 | Chen | 343/893 |
| 7,221,963 | B2 | 5/2007 | Ishihara et al. | |
| 7,619,582 | B2 | 11/2009 | Chung et al. | |
| 8,098,199 | B2 * | 1/2012 | Shinkai et al. | 342/374 |
| 2006/0044205 | A1 * | 3/2006 | Lynch et al. | 343/833 |

(Continued)

FOREIGN PATENT DOCUMENTS

| | | |
|---|---|---|
| JP | 6-152218 | 5/1994 |
| JP | 8-172423 | 7/1996 |

(Continued)

OTHER PUBLICATIONS

International Preliminary Report on Patentability issued Aug. 23, 2012 in International (PCT) Application No. PCT/JP2010/007488.

(Continued)

*Primary Examiner* — Trinh Dinh
(74) *Attorney, Agent, or Firm* — Wenderoth, Lind & Ponack, L.L.P.

(57) ABSTRACT

A feed element is configured to include a first antenna element having a first width, a dual-band forming inductor, and a second antenna element having a second width wider than the first width, where the first antenna element, the dual-band forming inductor, and a second antenna element are connected in series. The inductor is formed in a meander shape which has a trapezoidal envelope external shape to have a width formed to widen from the first width of a portion connected to the first antenna element toward a portion connected to the second antenna element. Cut portions each having a rectangular shape are further formed at corner portions of another ends of the parasitic elements, respectively.

2 Claims, 20 Drawing Sheets

(56) References Cited

U.S. PATENT DOCUMENTS

| | | | | |
|---|---|---|---|---|
| 2007/0030210 | A1* | 2/2007 | Shibata | 343/893 |
| 2007/0046465 | A1 | 3/2007 | Sakama et al. | |
| 2010/0182214 | A1* | 7/2010 | Honda et al. | 343/834 |
| 2010/0231453 | A1 | 9/2010 | Shinkai et al. | |
| 2011/0193761 | A1* | 8/2011 | Shinkai et al. | 343/817 |
| 2012/0075156 | A1* | 3/2012 | Noguchi et al. | 343/837 |

FOREIGN PATENT DOCUMENTS

| | | |
|---|---|---|
| JP | 8-288731 | 11/1996 |
| JP | 2000-134023 | 5/2000 |
| JP | 2001-345633 | 12/2001 |
| JP | 2003-298346 | 10/2003 |
| JP | 2004-228981 | 8/2004 |
| JP | 2005-142866 | 6/2005 |
| JP | 2007-60386 | 3/2007 |
| JP | 2009-77398 | 4/2009 |
| WO | 2009/050883 | 4/2009 |

OTHER PUBLICATIONS

International Search Report issued Mar. 22, 2011 in International (PCT) Application No. PCT/JP2010/007488.

* cited by examiner

VARIABLE DIRECTIVITY ANTENNA APPARATUS INCLUDING PARASITIC ELEMENTS HAVING CUT PORTION OF RECTANGULAR SHAPE

TECHNICAL FIELD

The present invention relates to a variable directivity antenna apparatus having one feed element and at least one parasitic element.

BACKGROUND ART

Among network configurations in which information terminals are mutually connected, a wireless network that uses wireless communications has advantages over a wire network that uses wire communications in the following points. The wireless network has portability and the degree of freedom in the arrangement of the information terminals higher than those of the wire network, and can reduce the weights of the information terminals by removing wired cables. Thus, wireless communication apparatuses have been not only utilized for data transmission between conventional personal computers but also currently mounted in a lot of home electric appliances, and the wireless communication is utilized for video and audio data transmission among the home electric appliances.

The wireless communication apparatuses has the above-described advantages, however, sometimes failed in normally transmitting data due to deterioration in the transmission characteristics under the influence of fading caused by delay waves that arrive after being reflected on objects when the wireless communication apparatuses are placed in a space where a number of reflective objects are placed, since the wireless communication apparatuses communicate with each other by radiating electromagnetic waves in the space. For example, when an Internet Video on Demand (VoD: Video on Demand) technology is utilized by using fixedly installed home electric appliances, such as a large-sized television broadcasting receiver apparatus, a Blu-ray Disc recording and reproducing apparatus or a DVD recorder, it is required to mount a function of connection to a wireless LAN (Local Area Network) on each of the home electric appliances and to provide a wireless LAN access point for connection to an Internet line. In this case, the fading is mainly caused by the movement of a human being who exists in the periphery of the television broadcasting receiver apparatus or the DVD recorder, and opening and closing of doors. In addition, when wireless communication apparatuses that are mounted in portable equipments such as a small-sized television broadcasting receiver apparatus such as a one-segment television broadcasting receiver apparatus, a portable DVD player or the like, and a wireless access point communicate with each other, the fading is mainly caused when the equipments are moved.

Conventionally, as measures against such fading, there have been proposed control methods such as directivity control and a variety of diversity processing of transceiving antennas. For example, the Patent Documents 1 to 3 disclose prior art wireless communication apparatuses that receive wireless signals according to temporal changes in the radio wave propagation environment.

In addition, for the directivity control of the transceiving antennas, the following variable directivity antenna apparatus is proposed in the Patent Document 4. The variable directivity antenna apparatus has a feed antenna element and parasitic antenna elements, and one pair of PIN diodes is provided for each of the parasitic antenna elements. Inductors are provided at a predetermined interval in portions electromagnetically coupled to the other variable directivity antennas for each control line to connect the PIN diodes to a controller. The interval at which the inductors are provided is set to a length so that the interval between the inductors does not substantially resonate at the operating frequency of the variable directivity antenna.

CITATION LIST

Patent Document

Patent Document 1: Japanese Patent Laid-open Publication No. JP 2000-134023 A;

Patent Document 2: Japanese Patent Laid-open Publication No. JP 2005-142866 A;

Patent Document 3: Japanese Patent Laid-open Publication No. JP H08-172423 A; and Patent Document 4: International Laid-open Publication No. WO 2009/050883.

SUMMARY OF INVENTION

Technical Problem

Generally speaking, in a wireless communication apparatus, an antenna and a transceiver module are designed and evaluated individually, and thereafter, subjected to combination evaluation. Therefore, there is a number of uncertainties regarding whether or not optimal antenna designing is performed as a wireless equipment. According to the recent MIMO (Multiple Input Multiple Output) technology, the antenna technology and the modulation and demodulation technology have close relationships, and a plurality of antennas are used, as compared with the conventional SISO (Single Input Single Output) technology. Therefore, there is a number of problems in the inter-antenna arrangement and isolation.

In this case, when the antenna apparatus is configured for, for example, a dual-band wireless LAN that uses both of the 2.4-GHz band and the 5-GHz band, there has been the following problem. Since the band used for the wireless LAN of the 5-GHz band has a relatively wide range of 800 MHz, it is very difficult to secure an antenna gain of equal to or larger than a predetermined value and secure a front-to-back ratio (referred to as an FB ratio hereinafter) of equal to or larger than a predetermined value throughout the wide band.

It is an object of the present invention to provide a variable directivity antenna apparatus capable of solving the aforementioned problems, securing a relatively higher antenna gain than that of the prior art, and securing a larger FB ratio than that of the prior art throughout a wide band in the higher frequency band in a dual-band variable directivity antenna apparatus operable at two frequency bands.

Solution to Problem

A variable directivity antenna apparatus according to the present invention includes one feed element, and at least one parasitic element provided to be aligned with and electromagnetically close to the feed element, the parasitic element having one end connected to one end of a diode having grounded another end. A directivity of the variable directivity antenna apparatus is changed by turning on and off the diode. The feed element includes a first antenna element having a first width, a dual-band forming inductor, and a second antenna element having a second width wider than the first width. The first antenna element, the dual-band forming inductor, and the second antenna element are connected in series with each other. A cut portion having a rectangular shape is formed at a corner portion of another end of the parasitic element.

In the above-described variable directivity antenna apparatus, the second antenna element is formed to have the second width larger than a length in a longitudinal direction of the second antenna element.

In addition, the above-described variable directivity antenna apparatus, further includes two parasitic elements provided to be aligned with each other so that the feed element is interposed between the two parasitic elements.

Advantageous Effects of Invention

According to the variable directivity antenna apparatus of the present invention, a cut portion having a rectangular shape is formed at a corner portion of another end of the parasitic element. Therefore, it is possible to provide a dual-band variable directivity antenna apparatus capable of securing a relatively higher antenna gain than that of the prior art, and securing a relatively larger FB ratio than that the prior art throughout a wide range at the higher frequency band.

BRIEF DESCRIPTION OF DRAWINGS

FIG. 6B is a graph showing a schematic radiation pattern of the variable directivity antenna apparatus 1 when only the parasitic element 1*b* of FIG. 1 is turned on;

FIG. 6C is a graph showing a schematic radiation pattern of the variable directivity antenna apparatus 1 when the parasitic elements 1*a* and 1*b* of FIG. 1 are turned on;

FIG. 6D is a graph showing a schematic radiation pattern of the variable directivity antenna apparatus 1 when only the parasitic element 1*a* of FIG. 1 is turned on;

DESCRIPTION OF EMBODIMENTS

Figure 1:
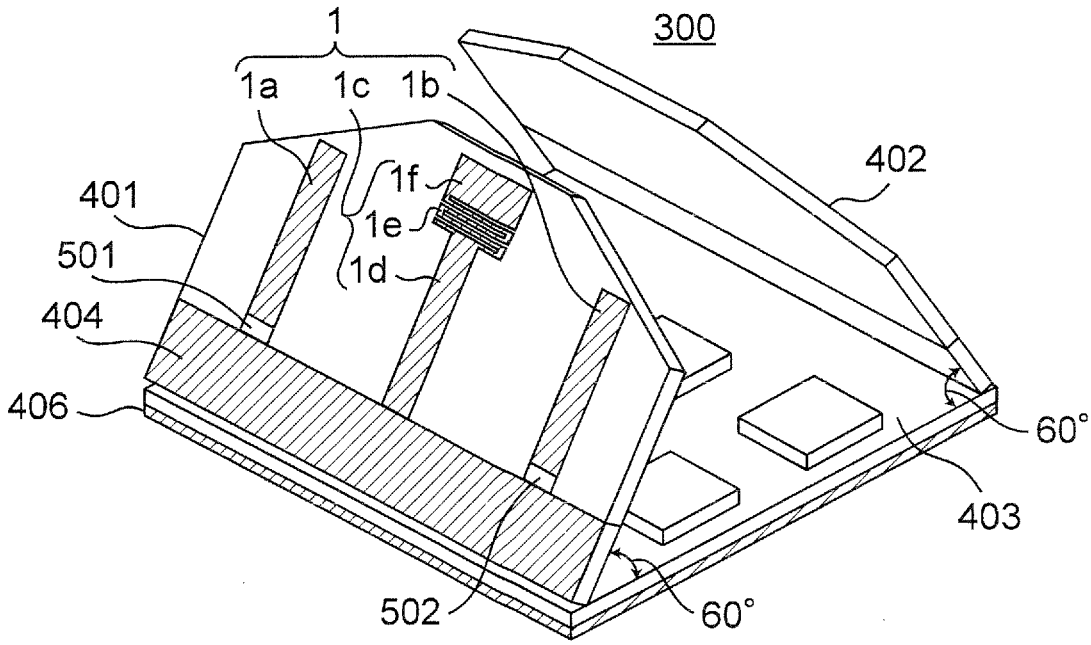
FIG. 1 is a perspective view showing an external appearance of a wireless communication apparatus 300 including a variable directivity antenna apparatus 1 of a type A0 according to one preferred embodiment of the present invention.

Preferred embodiments according to the present invention will be described below with reference to the attached drawings. In the following preferred embodiments, components similar to each other are denoted by the same reference numerals.

Figure 2:
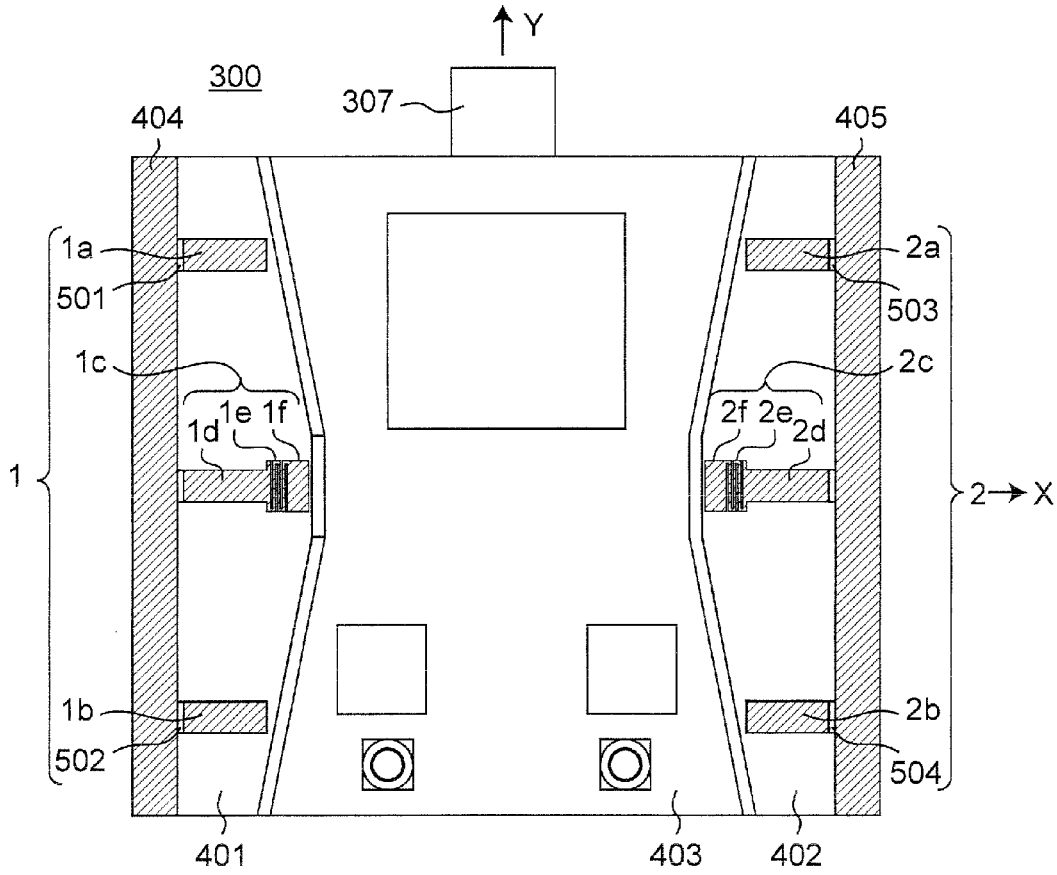
FIG. 2 is a plan view of the wireless communication apparatus 300 of FIG. 1.

FIG. 1 is a perspective view showing an external appearance of a wireless communication apparatus 300 including a variable directivity antenna apparatus 1 of a type A0 according to one preferred embodiment of the present invention. FIG. 2 is a plan view of the wireless communication apparatus 300 of FIG. 1, and FIG. 3 is a block diagram showing an inner structure of the wireless communication apparatus 300 of FIG. 1.

Figure 3:
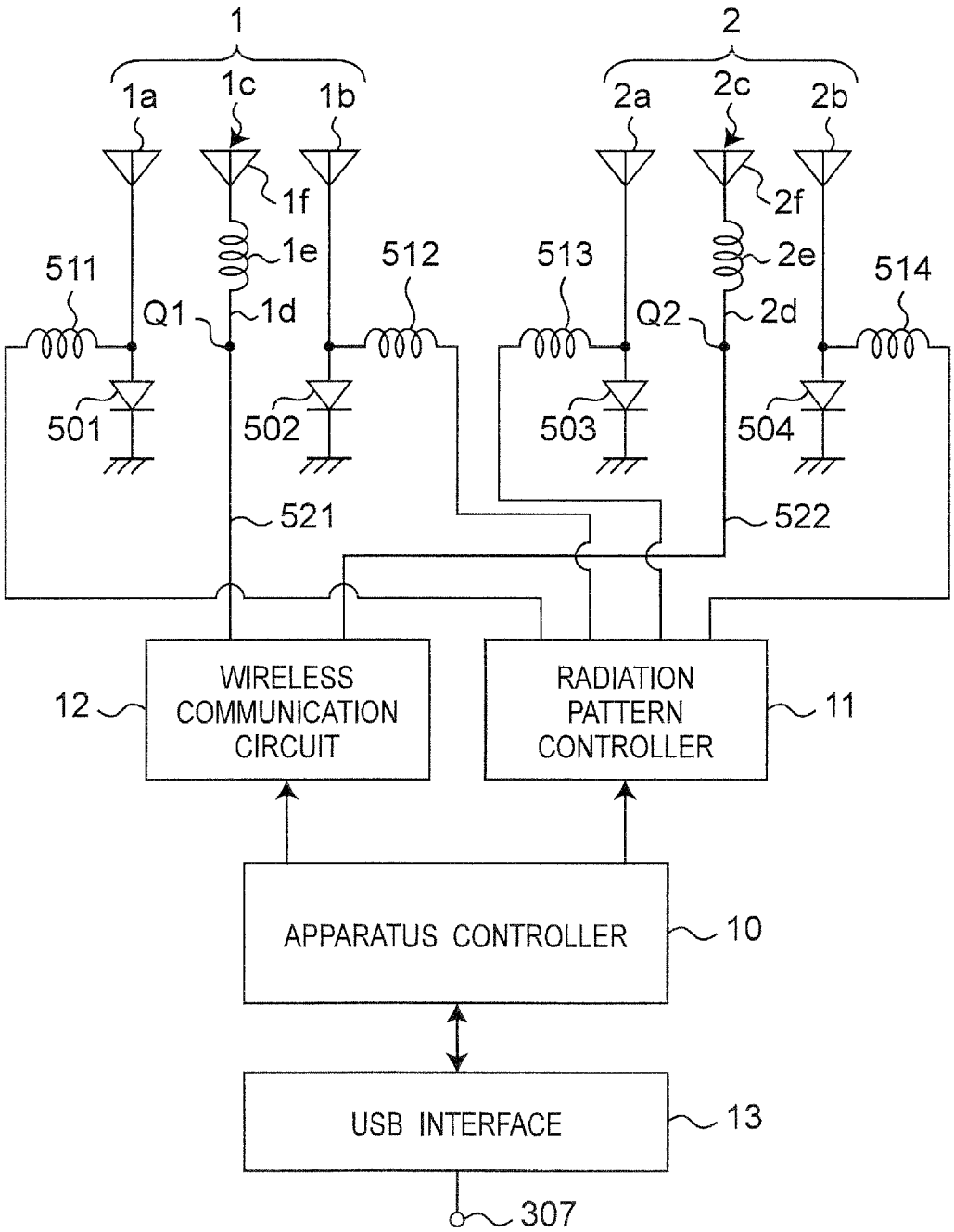
FIG. 3 is a block diagram showing an inner structure of the wireless communication apparatus 300 of FIG. 1.

Referring to FIGS. 1 to 3, the wireless communication apparatus 300 is, for example, a wireless communication apparatus of a 2×2 MIMO transmission system conforming to the wireless LAN communication standard IEEE802.11n. As shown in FIG. 2, the wireless communication apparatus 300 is configured to include variable directivity antenna apparatuses 1 and 2, an apparatus controller 10 for controlling the operation of the entire apparatus, a radiation pattern controller 11 for controlling the radiation patterns of the variable directivity antenna apparatuses 1 and 2, a wireless communication circuit 12 including a wireless transceiver circuit for transmitting a wireless transmitting signal via the variable directivity antenna apparatuses 1 and 2 and for receiving a wireless receiving signal via the variable directivity antenna apparatuses 1 and 2, a USB (Universal Serial Bus) interface 13 for receiving an electric power from an external apparatus and for transmitting and receiving signals, and a USB connector 307 connected to the USB interface 13.

Referring to FIGS. 1 to 3, the variable directivity antenna apparatus 1 is configured to include a feed element 1*c*, and parasitic elements 1*a* and 1*b*, where the feed element 1*c*, and parasitic elements 1*a* and 1*b* are formed on an antenna apparatus substrates 401. The parasitic elements 1*a* and 1*b* are aligned in substantially parallel to each other so that the feed element 1*c* is interposed between the parasitic elements 1*a* and 1*b* at an interval of one-fourth of an operating wavelength, and so as to be electromagnetically coupled to the feed element 1*c*. The parasitic element 1*a* is grounded via a PIN diode 501, and is connected to the radiation pattern controller 11 via a high-frequency blocking inductor 511. In addition, the parasitic element 1*b* is grounded via a PIN diode 502, and is connected to the radiation pattern controller 11 via a high-frequency blocking inductor 512. Further, the feed element 1*c* is configured by connecting in series a top loading type antenna element 1*f*, a dual-band forming inductor 1*e*, and an antenna element 1*d*. A feeding point Q1 at one end of the antenna element 1*d* is connected to the wireless communication circuit 12 via a feeder cable 521. In this case, the radiation pattern controller 11 changes the directivity of the variable directivity antenna apparatus 1 by turning on or off the PIN diodes 501 and 502 by applying or not applying predetermined control voltages to the PIN diodes 501 and 502, respectively. As described in detail later with reference to FIG. 6, for example, the parasitic elements 1*a* and 1*b*, which are connected to the PIN diodes 501 and 502 turned on, operate as reflectors, respectively. In the present preferred embodiment, when the PIN diodes 501 and 502 connected to the parasitic elements 1*a* and 1*b* are turned on, the parasitic elements 1*a* and 1*b* are hereinafter referred as that they are turned on.

When the PIN diodes 501 and 502 connected to the parasitic elements 1*a* and 1*b* are turned off, the parasitic elements 1*a* and 1*b* are hereinafter referred to that they are turned off.

Referring to FIGS. 1 to 3, the variable directivity antenna apparatus 2 is configured to include a feed element 2*c*, and parasitic elements 2*a* and 2*b*, where the feed element 2*c*, and parasitic elements 2*a* and 2*b* are formed on an antenna apparatus substrates 402, in a manner similar to that of the variable directivity antenna apparatus 1. The parasitic elements 2*a* and 2*b* are aligned substantially parallel to each other so that the feed element 2*c* is interposed between the parasitic elements 2*a* and 2*b* at an interval of one-fourth of an operating wavelength, and so as to be electromagnetically coupled to the feed element 2*c*. The parasitic element 2*a* is grounded via a PIN diode 503, and is connected to the radiation pattern controller 11 via a high-frequency blocking inductor 513. In addition, the parasitic element 2*b* is grounded via a PIN diode 504, and is connected to the radiation pattern controller 11 via a high-frequency blocking inductor 514. Further, the feed element 2*c* is configured by connecting in series a top loading type antenna element 2*f*, a dual-band forming inductor 2*e*, and an antenna element 2*d*. A feeding point Q2 at one end of the antenna element 2*d* is connected to the wireless communication circuit 12 via a feeder cable 522. In this case, the radiation pattern controller 11 changes the directivity of the variable directivity antenna apparatus 2 by turning on or off the PIN diodes 503 and 504 by applying or not applying predetermined control voltages to the PIN diodes 503 and 504, respectively. As described in detail later with reference to FIG. 6, for example, the parasitic elements 2*a* and 2*b*, which are connected to the PIN diodes 503 and 504 turned on, operate as reflectors, respectively. In the present preferred embodiment, when the PIN diodes 503 and 504 connected to the parasitic elements 2*a* and 2*b* are turned on, the parasitic elements 2*a* and 2*b* are referred hereinafter that they are be turned on. When the PIN diodes 503 and 504 connected to the parasitic elements 2*a* and 2*b* are turned off, the parasitic elements 2*a* and 2*b* are referred hereinafter that they are turned off.

Referring to FIGS. 1 and 2, the antenna apparatus substrates 401 and 402 are connected to opposite two sides of an antenna apparatus substrate 403 and are fixed to the antenna apparatus substrate 403 with an angle of 60 degrees with respect to the antenna apparatus substrate 403. In addition, the USB connector 307 is fixed to a further one side of the antenna apparatus substrate 403. In addition, a grounding conductor 406 is formed on the back surface of the antenna apparatus substrate 403.

Referring to FIGS. 1 and 2, the antenna apparatus substrates 401 and 402 are connected to opposite two sides of an antenna apparatus substrate 403 and are fixed to the antenna apparatus substrate 403 with an angle of 60 degrees with respect to the antenna apparatus substrate 401. In addition, the USB connector 307 is fixed to a further one side of the antenna apparatus substrate 403. In addition, a grounding conductor 406 is formed on the back surface of the antenna apparatus substrate 403.

Figure 4:
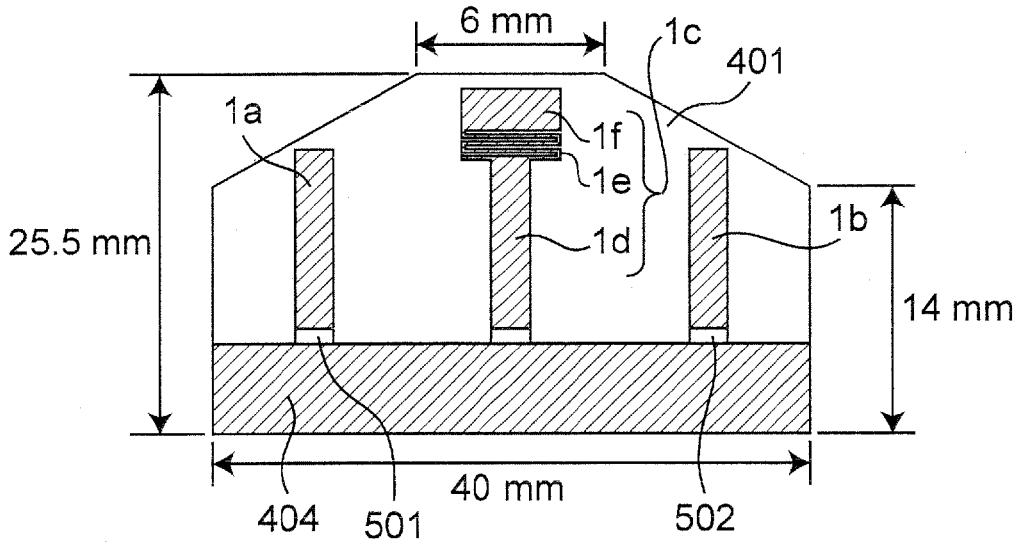
FIG. 4 is a plan view of an antenna apparatus substrate 401 of FIG. 1.
Figure 5:
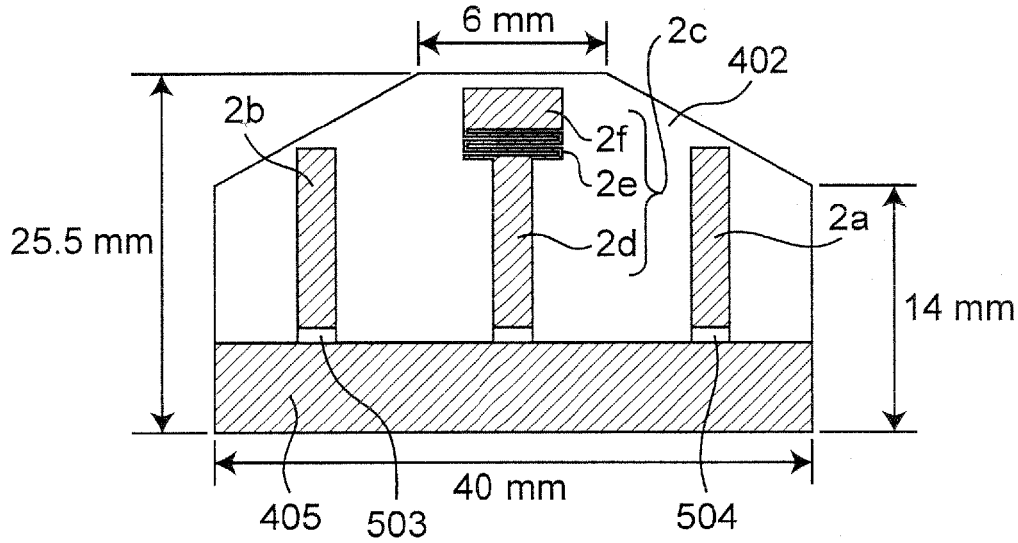
FIG. 5 is a plan view of an antenna apparatus substrate 402 of FIG. 1.

FIG. 4 is a plan view of the antenna apparatus substrate 401 of FIG. 1, and FIG. 5 is a plan view of the antenna apparatus substrate 402 of FIG. 1. FIGS. 4 and 5 show a prototype apparatus of an experimental example according to the present preferred embodiment.

Figure 6A:
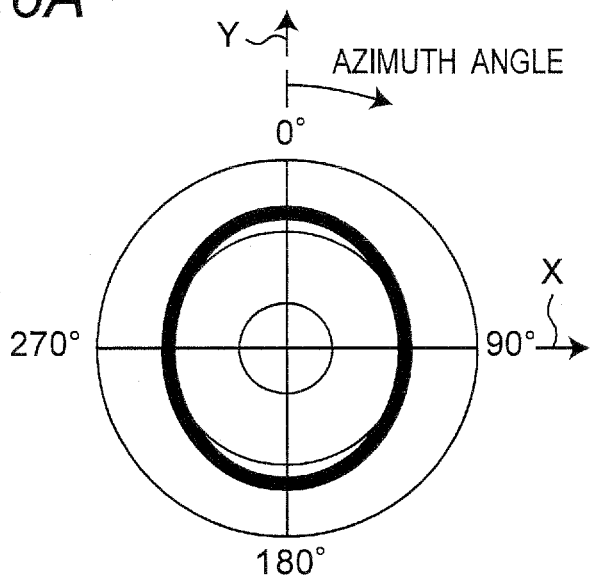
FIG. 6A is a graph showing a schematic radiation pattern of the variable directivity antenna apparatus 1 when parasitic elements 1*a* and 1*b* of FIG. 1 are turned off.
Figure 6B:
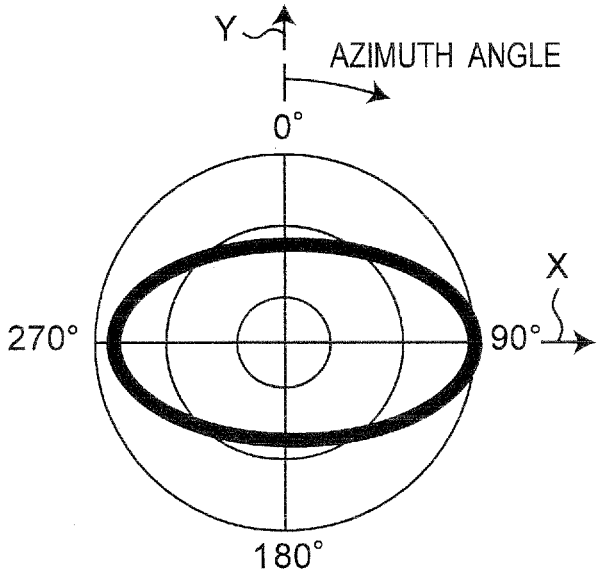
Figure 6C:
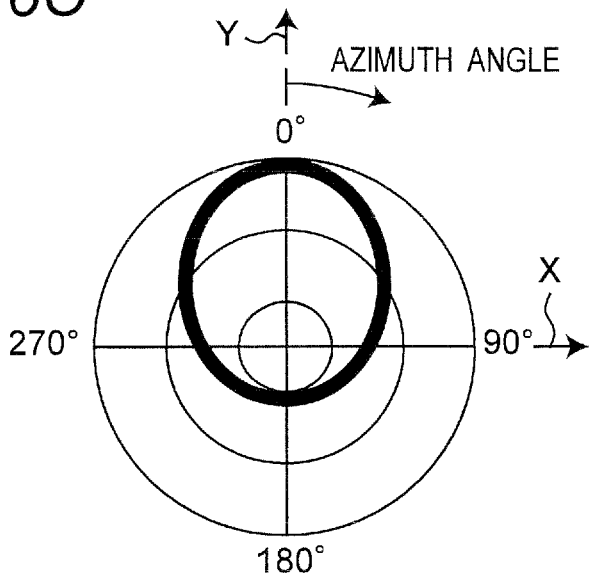
Figure 6D:
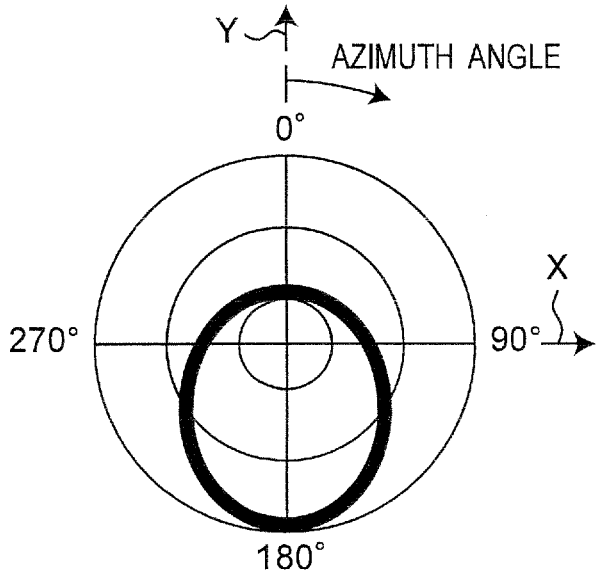

FIG. 6A is a graph showing a schematic radiation pattern of the variable directivity antenna apparatus 1 when the parasitic elements 1*a* and 1*b* of FIG. 1 are turned off. FIG. 6B is a graph showing a schematic radiation pattern of the variable directivity antenna apparatus 1 when only the parasitic element 1*b* of FIG. 1 is turned on. FIG. 6C is a graph showing a schematic radiation pattern of the variable directivity antenna apparatus 1 when the parasitic elements 1*a* and 1*b* of FIG. 1 are turned on. FIG. 6D is a graph showing a schematic radiation pattern of the variable directivity antenna apparatus 1 when only the parasitic element 1*a* of FIG. 1 is turned on.

As shown in FIG. 6A, when the parasitic elements 1*a* and 1*b* are turned off, the parasitic elements 1*a* and 1*b* does not influence on the radiation pattern of the feed element 1*c*, and the radiation pattern of the variable directivity antenna apparatus 1 is the same as the radiation pattern of the feed element 1*c*, which is substantially omnidirectional. Further, by turning on at least one of the parasitic elements 1*a* and 1*b*, the radiation pattern of the variable directivity antenna apparatus 1 changes as shown in FIGS. 6B to 6D. Thus, the variable directivity antenna apparatus 1 has the four radiation patterns shown in FIGS. 6A to 6D.

Figure 7A:
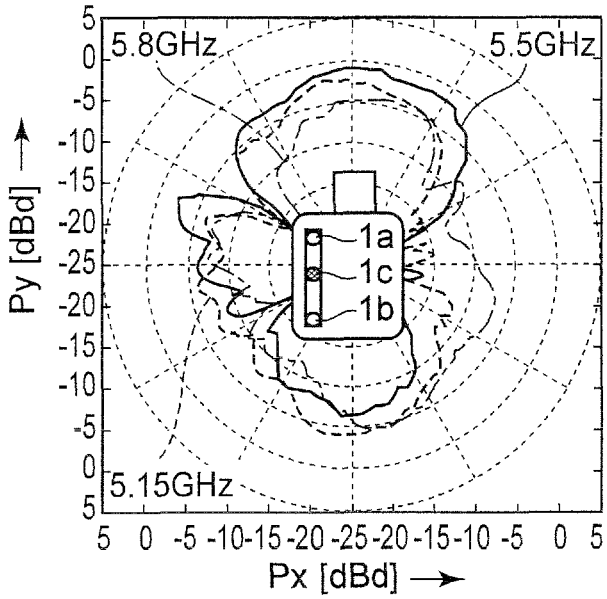
FIG. 7A is a graph showing a radiation pattern of the variable directivity antenna apparatus 1 when the parasitic elements 1*a* and 1*b* of FIG. 1 are turned off, where the radiation pattern showing experimental results of a prototype apparatus of the variable directivity antenna apparatus 1 of the type A0 shown in FIGS. 1 and 2.
Figure 7B:
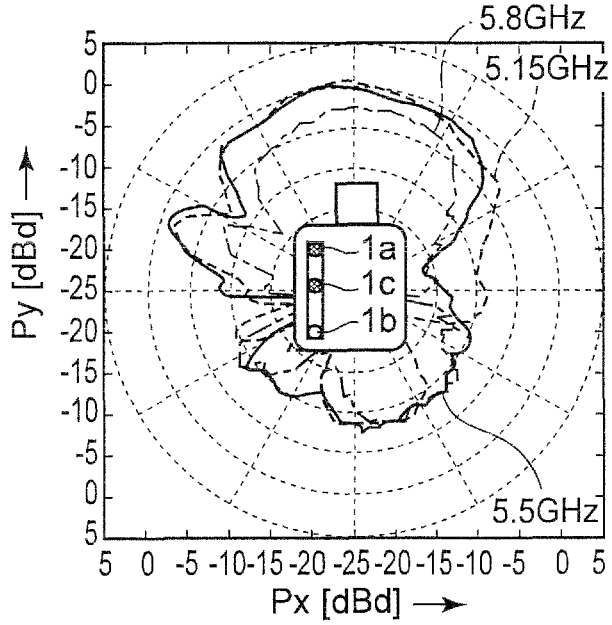
FIG. 7B is a graph showing a radiation pattern of the variable directivity antenna apparatus 1 when only the parasitic element 1*b* of FIG. 1 is turned on, where the radiation pattern showing experimental results of the prototype apparatus of the variable directivity antenna apparatus 1 of the type A0 shown in FIGS. 1 and 2.
Figure 7C:
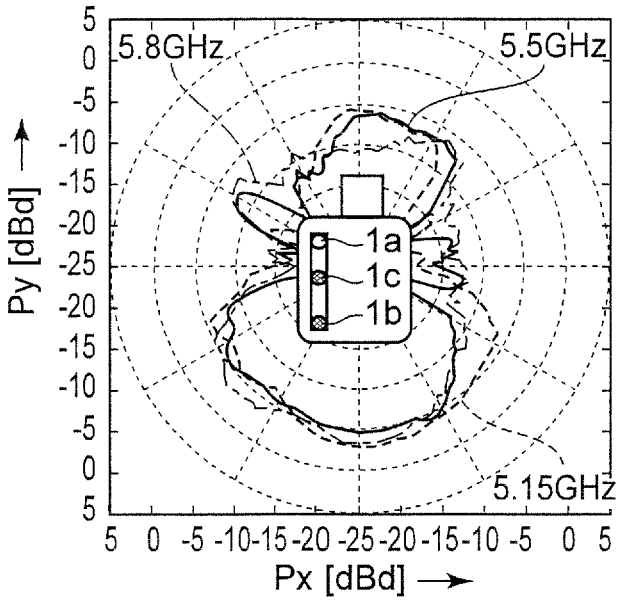
FIG. 7C is a graph showing a schematic radiation pattern of the variable directivity antenna apparatus 1 when only the parasitic element 1*a* of FIG. 1 is turned on, where the radiation pattern showing experimental results of the prototype apparatus of the variable directivity antenna apparatus 1 of the type A0 shown in FIGS. 1 and 2.
Figure 7D:
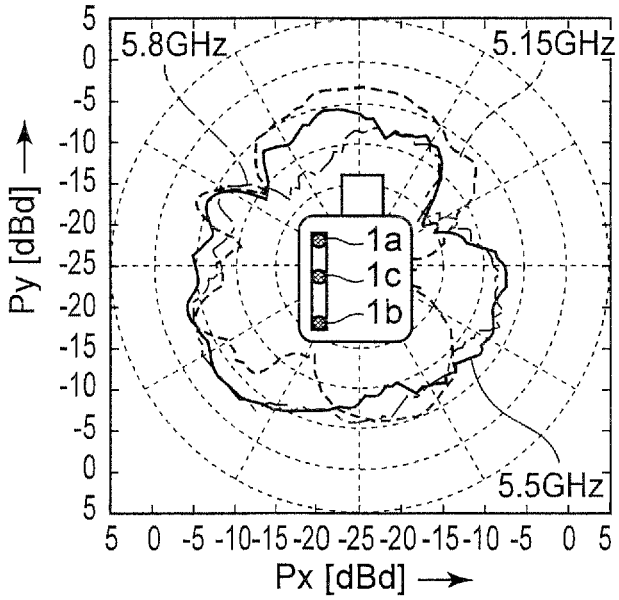
FIG. 7D is a graph showing a schematic radiation pattern of the variable directivity antenna apparatus 1 when the parasitic elements 1*a* and 1*b* of FIG. 1 are turned on, where the radiation pattern showing experimental results of the prototype apparatus of the variable directivity antenna apparatus 1 of the type A0 shown in FIGS. 1 and 2.

FIGS. 7A to 7D show experimental results of the prototype apparatus of the variable directivity antenna apparatus of the type A0 shown in FIGS. 1 and 2. FIG. 7A is a graph showing a radiation pattern of the variable directivity antenna apparatus 1 when the parasitic elements 1*a* and 1*b* of FIG. 1 are turned off. FIG. 7B is a graph showing a radiation pattern of the variable directivity antenna apparatus 1 when only the parasitic element 1*b* of FIG. 1 is turned on. FIG. 7C is a graph showing a schematic radiation pattern of the variable directivity antenna apparatus 1 when only the parasitic element 1*a* of FIG. 1 is turned on. FIG. 7D is a graph showing a schematic radiation pattern of the variable directivity antenna apparatus 1 when the parasitic elements 1*a* and 1*b* of FIG. 1 are turned on. As apparent from FIGS. 7A to 7D, it can be understood that directivities similar to the schematic radiation patterns of FIGS. 6A to 6D can be obtained.

In the following FIGS. 8A, 8B, 9A, 9B, 10A, 10B, 11A and 11B, there will be described modified preferred embodiments. In each of the modified preferred embodiments, the antenna electrical characteristics are improved from those of the aforementioned preferred embodiment. Regarding the modified preferred embodiments, variable directivity antenna apparatuses are concretely described on a dual-band wireless LAN that uses both of the 2.4-GHz band and the 5-GHz band.

Figure 8A:
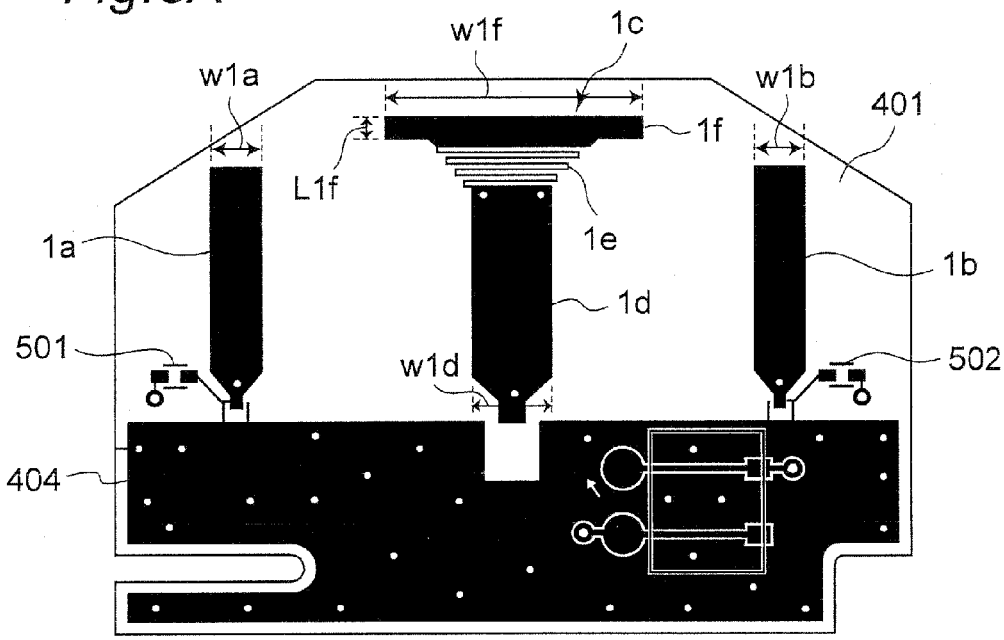
FIG. 8A is a plan view showing a conductor pattern on a front surface of the antenna apparatus substrate 401 of a variable directivity antenna apparatus 1 of a type A1 according to a first modified preferred embodiment of the present invention.
Figure 8B:
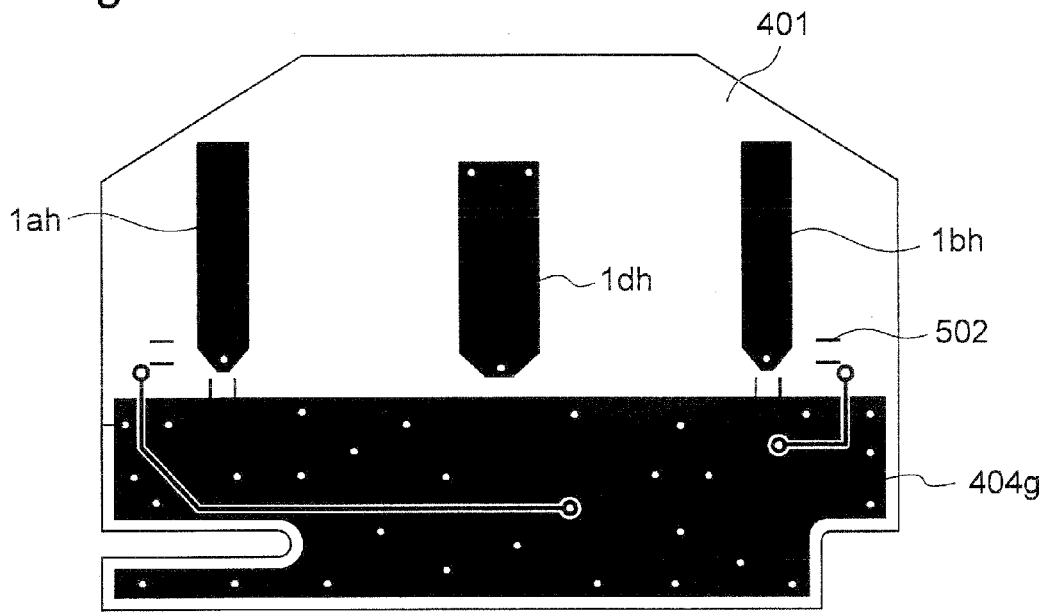
FIG. 8B is a perspective plan view showing a conductor pattern on a back surface of the antenna apparatus substrate 401 of FIG. 8A.

FIG. 8A is a plan view showing a conductor pattern on a front surface of an antenna apparatus substrate 401 of a variable directivity antenna apparatus 1 of a type A1 according to a first modified preferred embodiment of the present invention, and FIG. 8B is a perspective plan view showing a conductor pattern on a back surface of the antenna apparatus substrate 401 of FIG. 8A. Although FIG. 8B should be illustrated in a plan view, it is illustrated in the perspective plan view seen from the front surface (invisible portions are indicated by solid lines instead of dotted lines) for the sake of convenience in illustration, and the same things can be applied to FIGS. 9B, 10B and 11B.

Referring to FIG. 8A, a grounding conductor 404 of a roughly rectangular shape is formed on the downside on the front surface of the antenna apparatus substrate 401. A parasitic element 1*a* of a strip shape, a feed element 1*c*, and a parasitic element 1*b* of a strip shape are formed to be aligned with each other on the upper side on the front surface of the antenna apparatus substrate 401 at an interval of one-fourth of the operating wavelength. The feed element 1*c* is configured by connecting in series a top loading type antenna element 1*f* of a rectangular shape, a dual-band forming inductor 1*e*, and an antenna element 1*d* of a strip shape. The parasitic elements 1*a* and 1*b* and the antenna elements 1*d* and 1*e* are formed so that a width W1*d* of the antenna element 1*d* is wider than widths W1*a* and W1*b* of the parasitic elements 1*a* and 1*b*, respectively, and a width W1*f* of the antenna element if is wider than the width W1*d* of antenna element 1*d*. In this case, the antenna apparatus 1*f* is formed so that the width W1*f* thereof is larger than a length L1*f* in the longitudinal direction thereof.

In addition, referring to FIG. 8B, a grounding conductor 404*g* is formed on the back surface of the antenna apparatus substrate 401 to oppose to the grounding conductor 404 so that the antenna apparatus substrate 401 is sandwiched between the grounding conductors 404 and 404*g*. Parasitic elements 1*ah* and 1*bh* are formed to oppose to the parasitic elements 1*a* and 1*b*, respectively, so that the antenna apparatus substrate 401 is sandwiched between the parasitic elements 1*a* and 1*ah* and the antenna apparatus substrate 401 is sandwiched between the parasitic elements 1*b* and 1*bh*. Each pair of the opposing parasitic elements (1*a* and 1*ah*; 1*b* and 1*bh*) is connected via at least one through-hole conductor (not shown) to operate integratedly, where the through-hole conductor penetrates the antenna apparatus substrate 401 in the thickness direction thereof. In addition, an antenna element 1*dh* is formed to oppose to the antenna element 1*d* so that the antenna apparatus substrate 401 is sandwiched between the antenna elements 1*d* and 1*dh*. One pair of the opposing antenna elements (1*d* and 1*dh*) are connected via at least one through-hole conductor (not shown) to operate integratedly, where the through-hole conductor penetrates the antenna apparatus substrate 401 in the thickness direction thereof. It is noted that the integration of the elements on the front surface and the elements on the back surface is to increase the conductor thickness and to increase the withstand voltage.

Referring to FIG. 8A, in particular, the dual-band forming inductor 1*e* has a meander shape. The dual-band forming inductor 1*e* is formed in the meander shape to have a trapezoidal envelope external shape having an element width (which is the envelope width of the meander shape) formed to widen from an element width the same as the width W1*d* of the antenna element 1*d* at a connecting portion of the dual-band forming inductor 1*e* connected to the antenna element 1*d* toward the upside antenna element 1*f*. With this arrangement, an FB ratio in the directivity pattern of the antenna apparatus when the parasitic element 1*a* or 1*b* is turned on can be made larger than that of the preferred embodiment of FIGS. 1 to 5 and FIGS. 6A to 6D, as described in detail later.

Figure 9A:
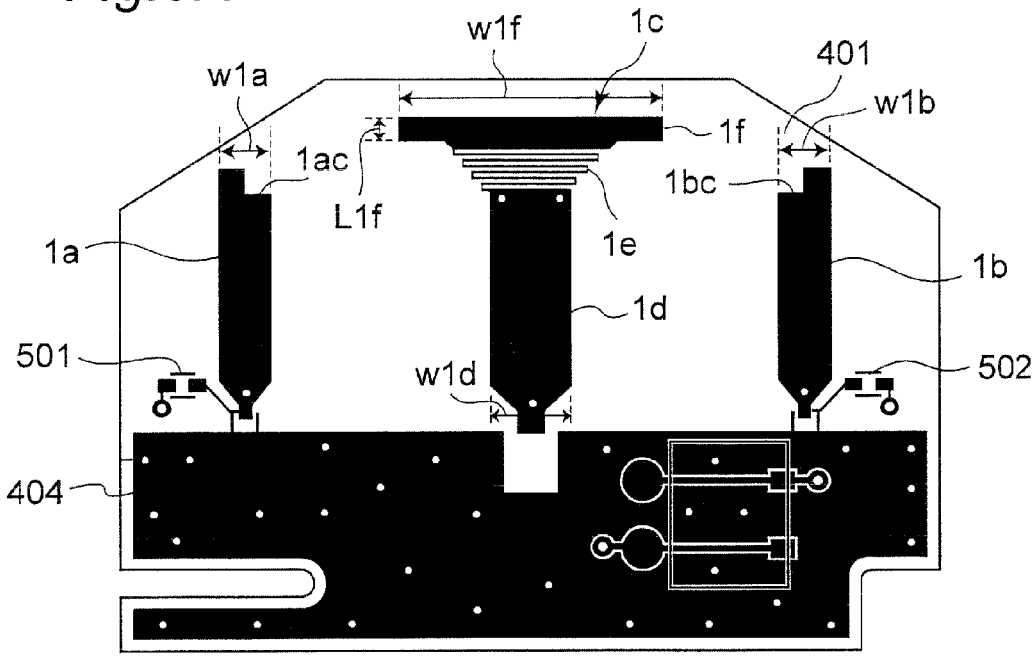
FIG. 9A is a plan view showing a conductor pattern on a front surface of an antenna apparatus substrate 401 of a variable directivity antenna apparatus 1 of a type B1 according to a second modified preferred embodiment of the present invention.
Figure 9B:
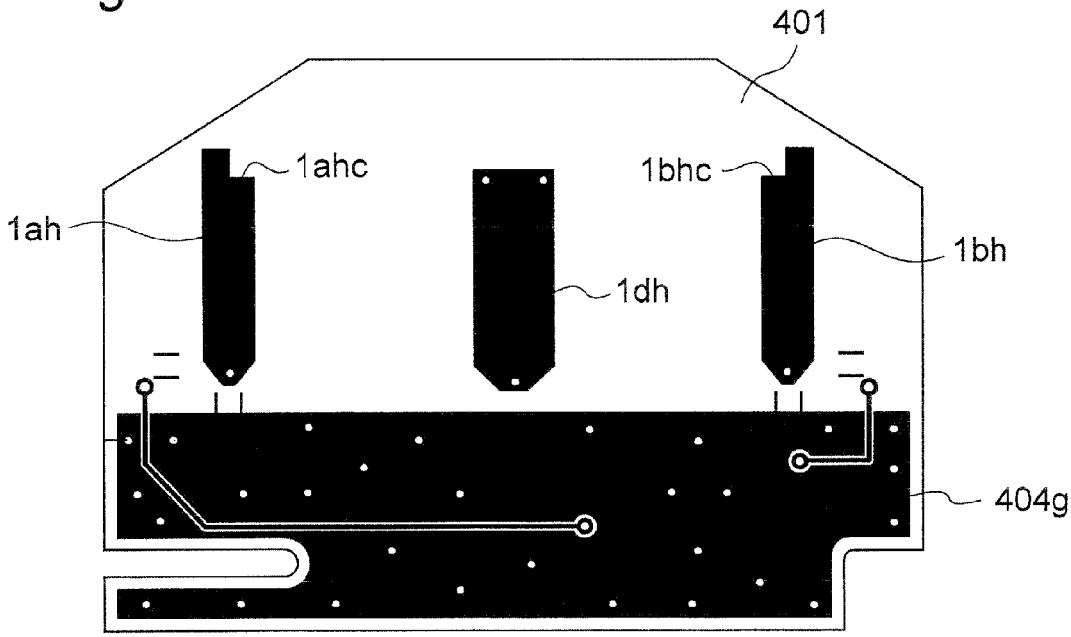
FIG. 9B is a perspective plan view showing a conductor pattern on a back surface of the antenna apparatus substrate 401 of FIG. 9A.

FIG. 9A is a plan view showing a conductor pattern on a front surface of an antenna apparatus substrate 401 of a variable directivity antenna apparatus 1 of a type B1 according to a second modified preferred embodiment of the present invention, and FIG. 9B is a perspective plan view showing a conductor pattern on a back surface of the antenna apparatus substrate 401 of FIG. 9A.

The second modified preferred embodiment is different from the first modified preferred embodiment of FIGS. 8A and 8B in the following points.

(1) In the parasitic element 1*a*, a cut portion 1*ac* of a rectangular shape is formed at an upper right end corner portion (which is a corner portion at another end different from one end connected to the PIN diode 501) opposing to the dual-band forming inductor 1*e* in the transverse direction, i.e., the upper right end corner portion of the parasitic element 1*a* is formed in a stepped shape.

(2) In the parasitic element 1*b*, a cut portion 1*bc* of a rectangular shape is formed at an upper left end corner portion (which is a corner portion at another end different from one end connected to the PIN diode 502) opposing to the dual-band forming inductor 1*e* in the transverse direction, i.e., the upper left end corner portion of the parasitic element 1*b* is formed in a stepped shape.

(3) In the parasitic element 1*ah*, a cut portion 1*ahc* of a rectangular shape is formed in a position (upper right end corner portion) opposing to the cut portion 1*ac* of the parasitic element 1*a*, i.e., the upper right end corner portion of the parasitic element 1*ah* is formed in a stepped shape.

(4) In the parasitic element 1*bh*, a cut portion 1*bhc* of a rectangular shape is formed in a position (upper left end corner portion) opposing to the cut portion 1*bc* of the parasitic element 1*b*, i.e., the upper left end corner portion of the parasitic element 1*bh* is formed in a stepped shape.

As described in detail later, in the second modified preferred embodiment, by forming the cut portions 1*ac*, 1*bc*, 1*ahc* and 1*bhc* at the parasitic elements 1*a*, 1*b*, 1*ah* and 1*bh*, respectively, it is possible to increase the FB ratio in the directivity pattern of the antenna apparatus when the parasitic element 1*a* or 1*b* is turned on, than that of the preferred embodiment of FIGS. 1 to 5 and FIGS. 6A to 6D. In addition, it is possible to increase the gain of the antenna apparatus than that of the first modified preferred embodiment.

Figure 10A:
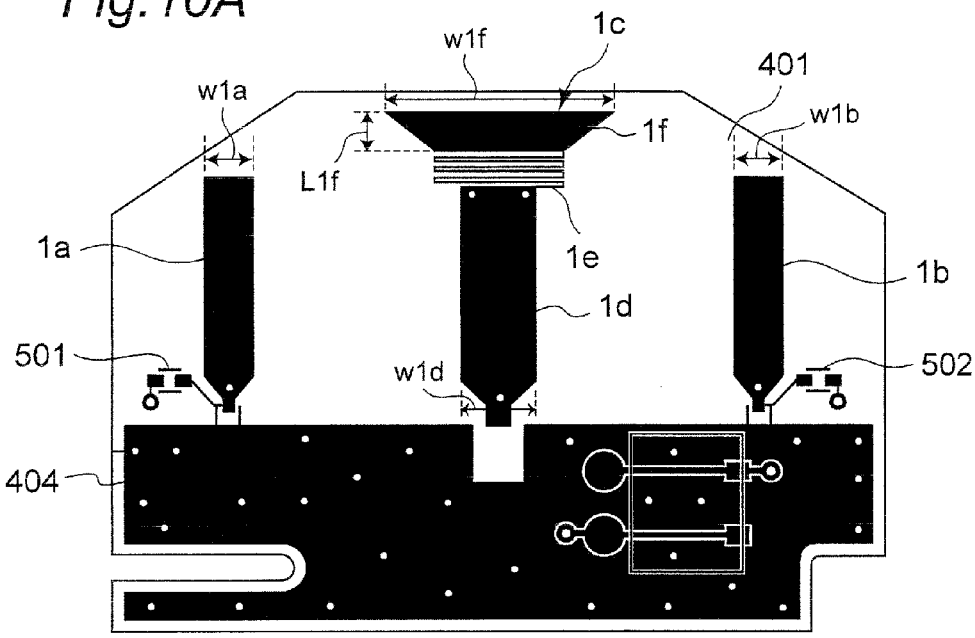
FIG. 10A is a plan view showing a conductor pattern on a front surface of an antenna apparatus substrate 401 of a variable directivity antenna apparatus 1 of a type A2 according to a third modified preferred embodiment of the present invention.
Figure 10B:
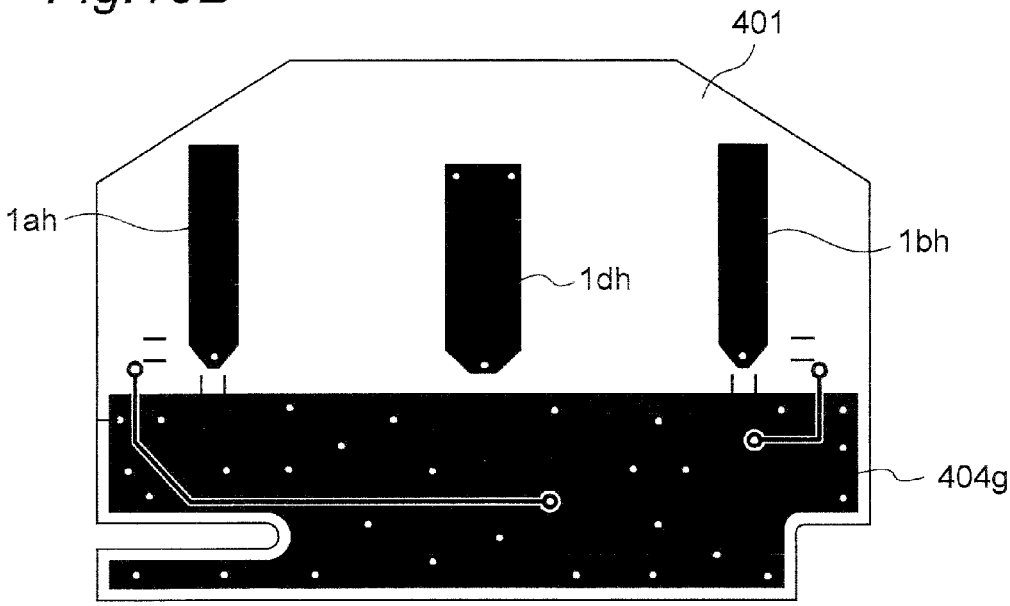
FIG. 10B is a perspective plan view showing a conductor pattern on a back surface of the antenna apparatus substrate 401 of FIG. 10A.

FIG. 10A is a plan view showing a conductor pattern on a front surface of an antenna apparatus substrate 401 of a variable directivity antenna apparatus 1 of a type A2 according to a third modified preferred embodiment of the present invention, and FIG. 10B is a perspective plan view showing a conductor pattern on a back surface of the antenna apparatus substrate 401 of FIG. 10A. The third modified preferred embodiment is different from the first modified preferred embodiment in the following points.

(1) The antenna element if is formed in a trapezoidal having an upper side wider than a lower side, instead of the rectangular shape.

(2) The dual-band forming inductor 1*e* is formed in a meander shape to have a rectangular envelope external shape instead of the meander shape that has the trapezoidal envelope external shape.

Figure 11A:
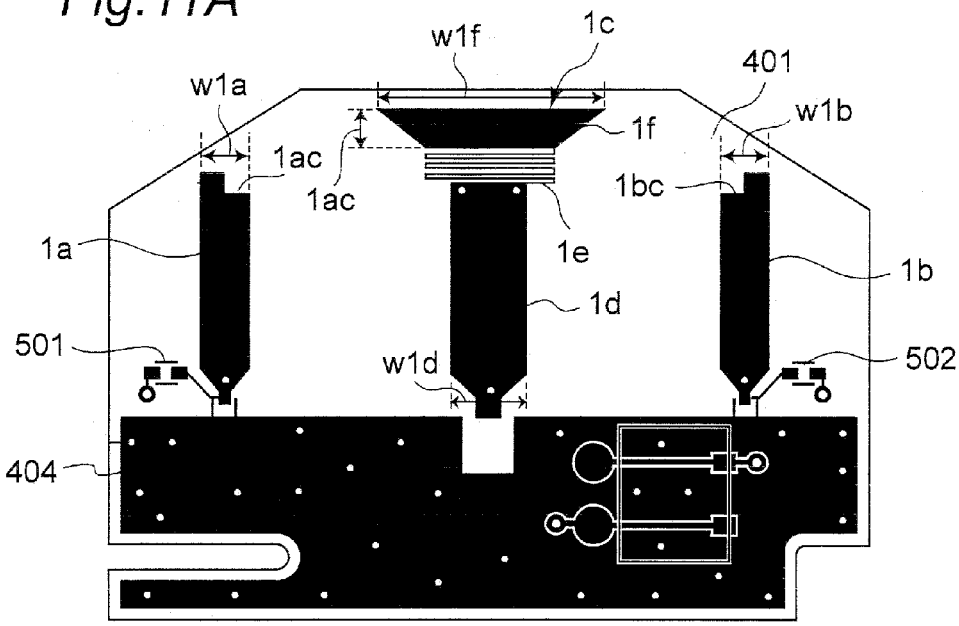
FIG. 11A is a plan view showing a conductor pattern on a front surface of an antenna apparatus substrate 401 of a variable directivity antenna apparatus 1 of a type B2 according to a fourth modified preferred embodiment of the present invention.
Figure 11B:
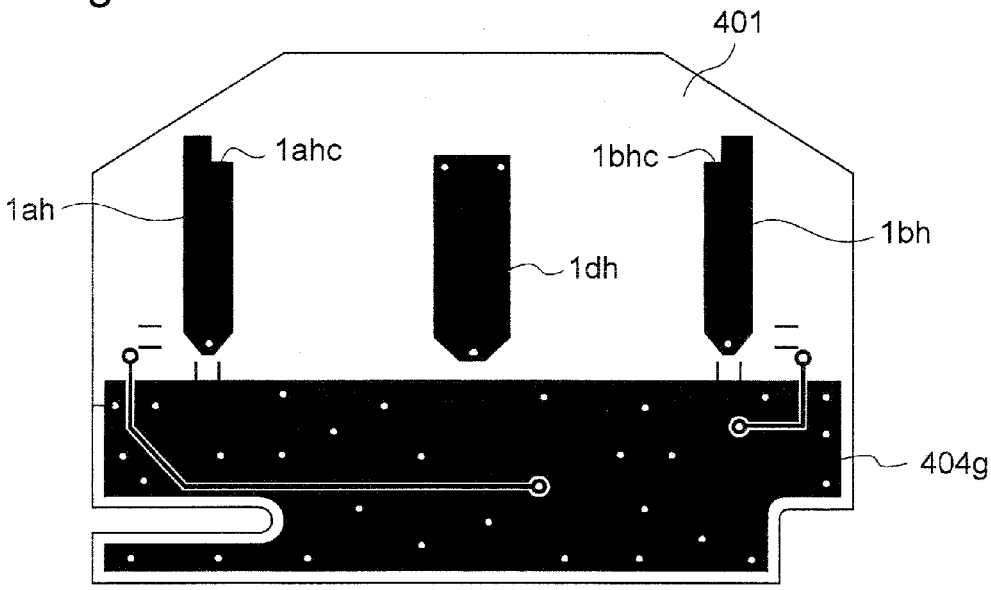
FIG. 11B is a perspective plan view showing a conductor pattern on a back surface of the antenna apparatus substrate 401 of FIG. 11A.

FIG. 11A is a plan view showing a conductor pattern on a front surface of an antenna apparatus substrate 401 of a variable directivity antenna apparatus 1 of a type B2 according to a fourth modified preferred embodiment of the present invention, and FIG. 11B is a perspective plan view showing a conductor pattern on a back surface of the antenna apparatus substrate 401 of FIG. 11A. The fourth modified preferred embodiment is different from the third modified preferred embodiment in that the cut portions 1*ac*, 1*bc*, 1*ahc* and 1*bhc* are formed at the parasitic elements 1*a*, 1*b*, 1*ah* and 1*bh*, respectively.

Next, experimental results of the prototype apparatuses of the variable directivity antenna apparatuses 1 of the first to fourth modified preferred embodiments are described below.

Figure 12A:
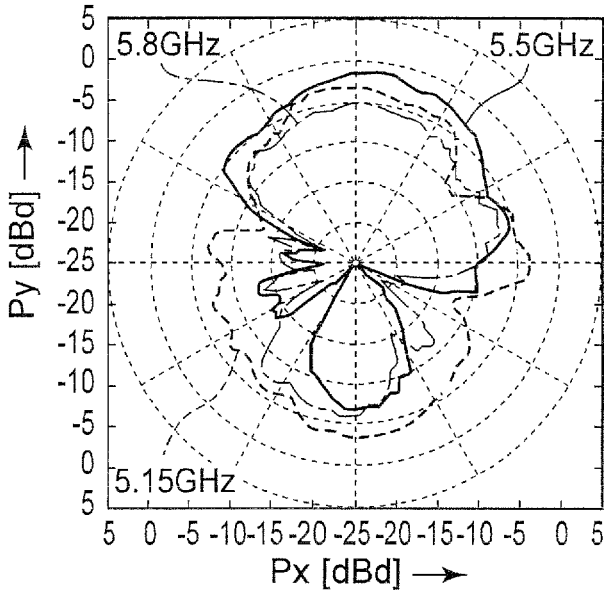
FIG. 12A is a graph showing a radiation pattern of the variable directivity antenna apparatus 1 when the parasitic elements 1*a* and 1*b* of FIG. 8A are turned off, where the radiation pattern showing experimental results of the prototype apparatus of the variable directivity antenna apparatus of the type A1 shown in FIGS. 8A and 8B.
Figure 12B:
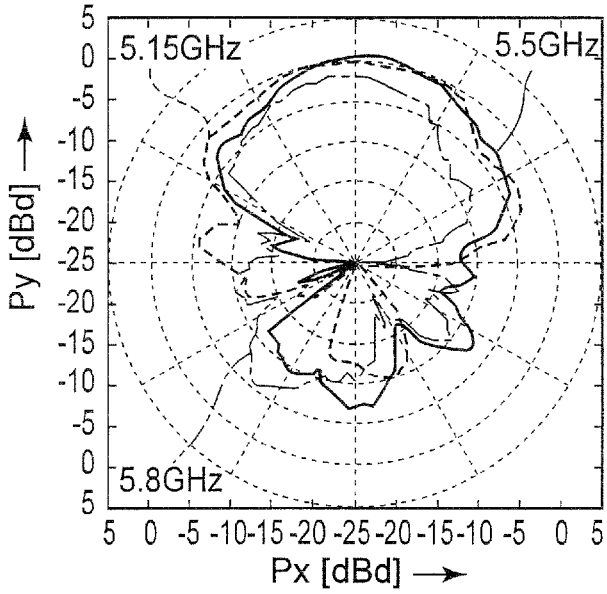
FIG. 12B is a graph showing a radiation pattern of the variable directivity antenna apparatus 1 when only the parasitic element 1*b* of FIG. 8A is turned on, where the radiation pattern showing experimental results of the prototype apparatus of the variable directivity antenna apparatus of the type A1 shown in FIGS. 8A and 8B.
Figure 12C:
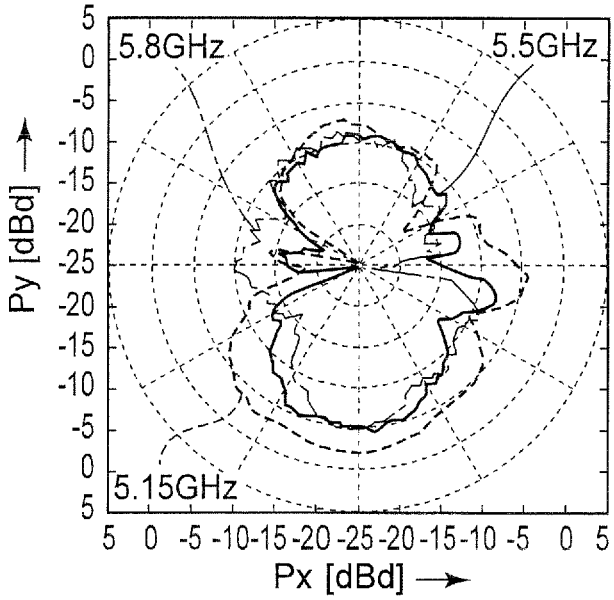
FIG. 12C is a graph showing a schematic radiation pattern of the variable directivity antenna apparatus 1 when only the parasitic element 1*a* of FIG. 8A is turned on, where the radiation pattern showing experimental results of the prototype apparatus of the variable directivity antenna apparatus of the type A1 shown in FIGS. 8A and 8B.
Figure 12D:
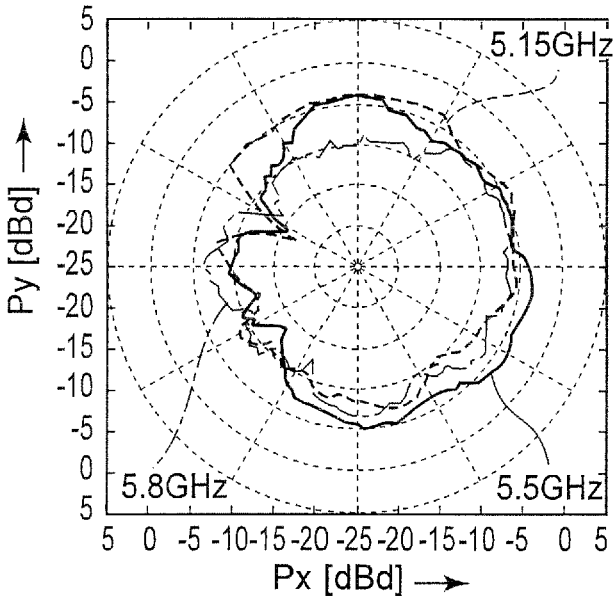
FIG. 12D is a graph showing a schematic radiation pattern of the variable directivity antenna apparatus 1 when the parasitic elements 1*a* and 1*b* of FIG. 8A are turned on, where the radiation pattern showing experimental results of the prototype apparatus of the variable directivity antenna apparatus of the type A1 shown in FIGS. 8A and 8B.
Figure 13A:
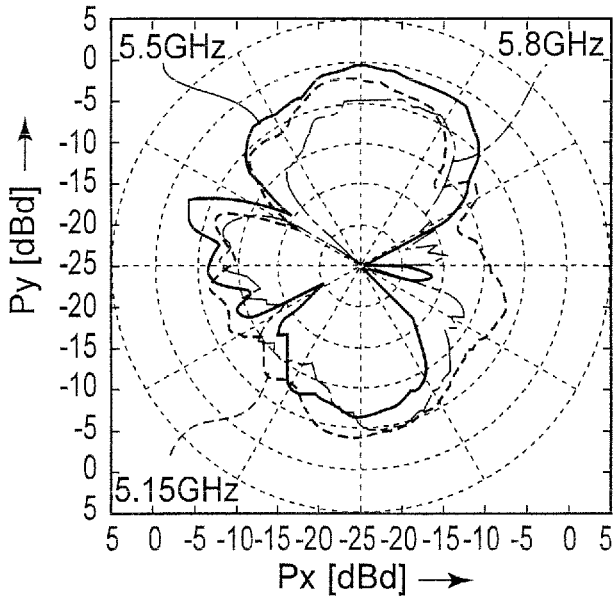
FIG. 13A is a graph showing a radiation pattern of the variable directivity antenna apparatus 1 when the parasitic elements 1*a* and 1*b* of FIG. 9A are turned off, where the radiation pattern showing experimental results of the prototype apparatus of the variable directivity antenna apparatus of the type B1 shown in FIGS. 9A and 9B.
Figure 13B:
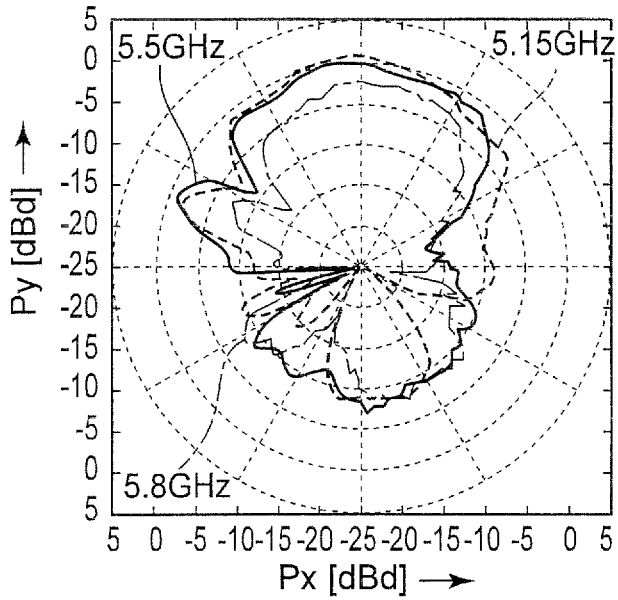
FIG. 13B is a graph showing a radiation pattern of the variable directivity antenna apparatus 1 when only the parasitic element 1*b* of FIG. 9A is turned on, where the radiation pattern showing experimental results of the prototype apparatus of the variable directivity antenna apparatus of the type B1 shown in FIGS. 9A and 9B.
Figure 13C:
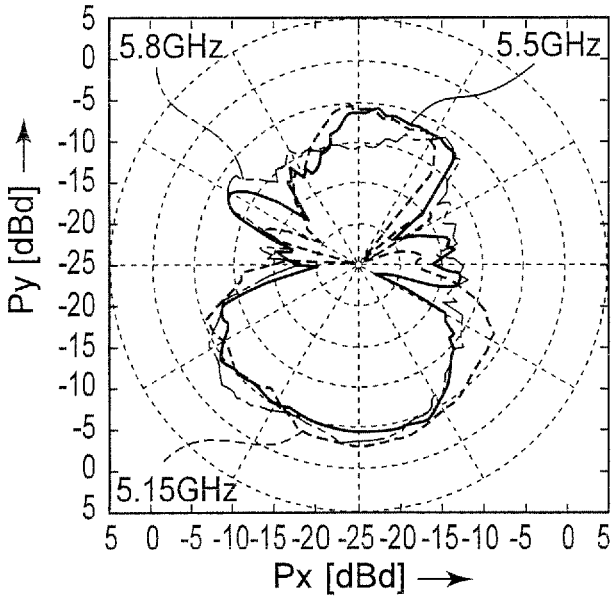
FIG. 13C is a graph showing a schematic radiation pattern of the variable directivity antenna apparatus 1 when only the parasitic element 1*a* of FIG. 9A is turned on, where the radiation pattern showing experimental results of the prototype apparatus of the variable directivity antenna apparatus of the type B1 shown in FIGS. 9A and 9B.
Figure 13D:
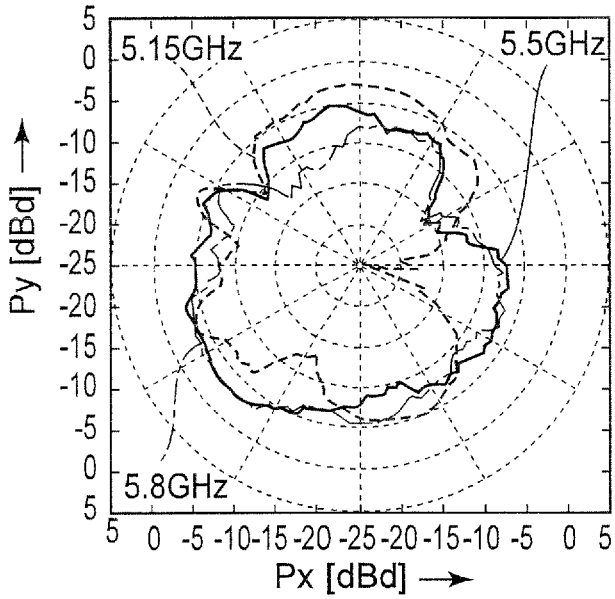
FIG. 13D is a graph showing a schematic radiation pattern of the variable directivity antenna apparatus 1 when the parasitic elements 1*a* and 1*b* of FIG. 9A are turned on, where the radiation pattern showing experimental results of the prototype apparatus of the variable directivity antenna apparatus of the type B1 shown in FIGS. 9A and 9B.
Figure 14A:
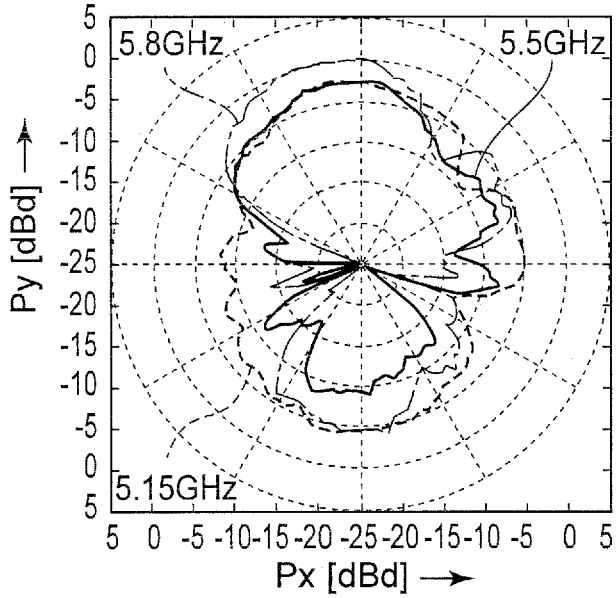
FIG. 14A is a graph showing a radiation pattern of the variable directivity antenna apparatus 1 when the parasitic elements 1*a* and 1*b* of FIG. 10A are turned off, where the radiation pattern showing experimental results of the prototype apparatus of the variable directivity antenna apparatus of the type A2 shown in FIGS. 10A and 10B.
Figure 14B:
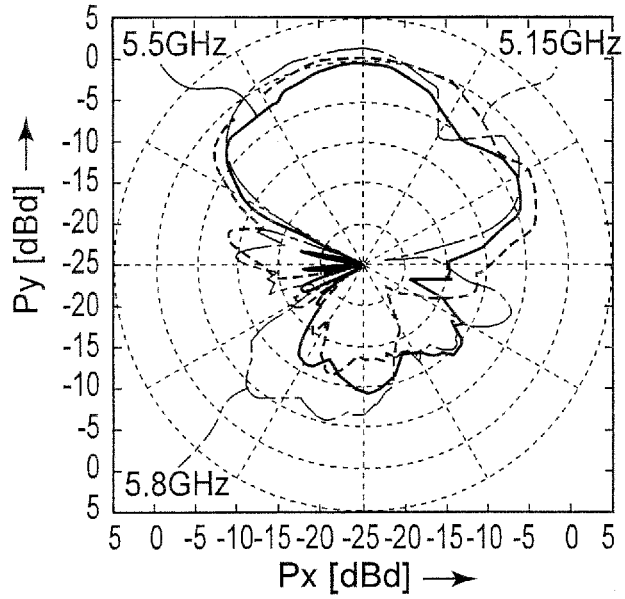
FIG. 14B is a graph showing a radiation pattern of the variable directivity antenna apparatus 1 when only the parasitic element 1*b* of FIG. 10A is turned on, where the radiation pattern showing experimental results of the prototype apparatus of the variable directivity antenna apparatus of the type A2 shown in FIGS. 10A and 10B.
Figure 14C:
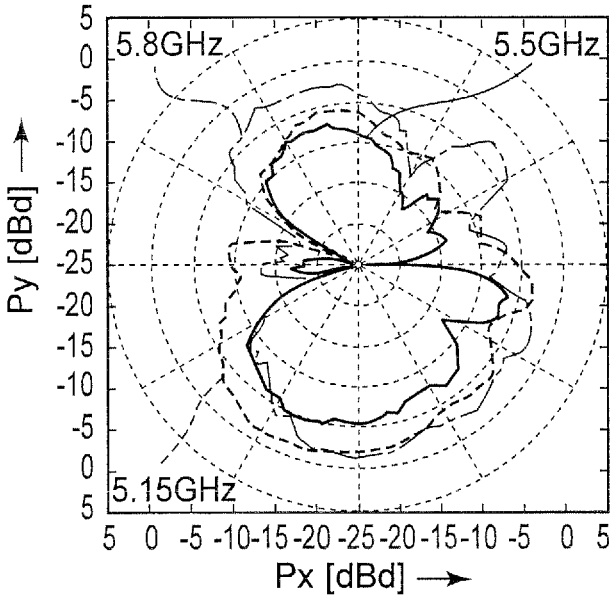
FIG. 14C is a graph showing a schematic radiation pattern of the variable directivity antenna apparatus 1 when only the parasitic element 1*a* of FIG. 10A is turned on, where the radiation pattern showing experimental results of the prototype apparatus of the variable directivity antenna apparatus of the type A2 shown in FIGS. 10A and 10B.
Figure 14D:
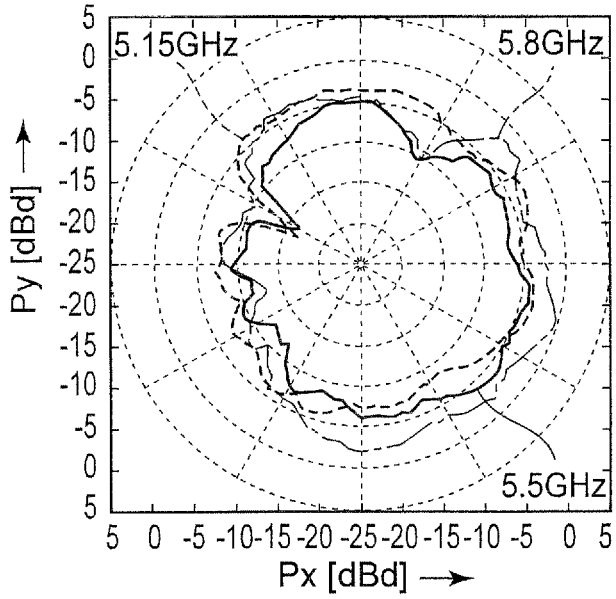
FIG. 14D is a graph showing a schematic radiation pattern of the variable directivity antenna apparatus 1 when the parasitic elements 1*a* and 1*b* of FIG. 10A are turned on, where the radiation pattern showing experimental results of the prototype apparatus of the variable directivity antenna apparatus of the type A2 shown in FIGS. 10A and 10B.
Figure 15A:
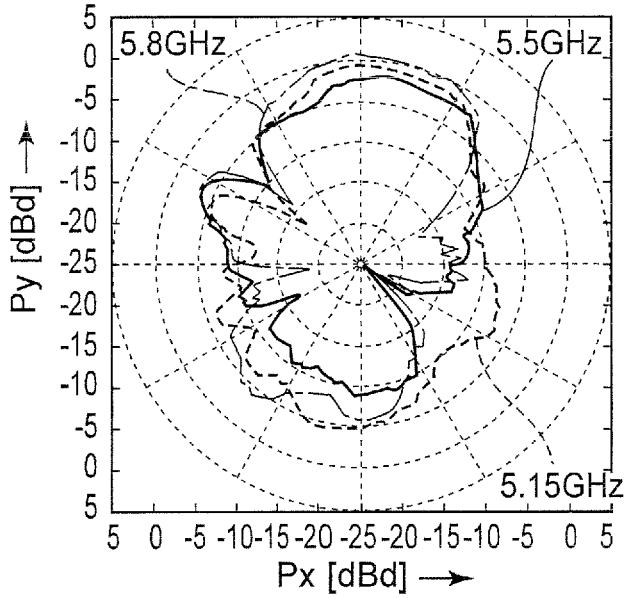
FIG. 15A is a graph showing a radiation pattern of the variable directivity antenna apparatus 1 when the parasitic elements 1*a* and 1*b* of FIG. 11A are turned off, where the radiation pattern showing experimental results of the prototype apparatus of the variable directivity antenna apparatus of the type B2 shown in FIGS. 11A and 11B.
Figure 15B:
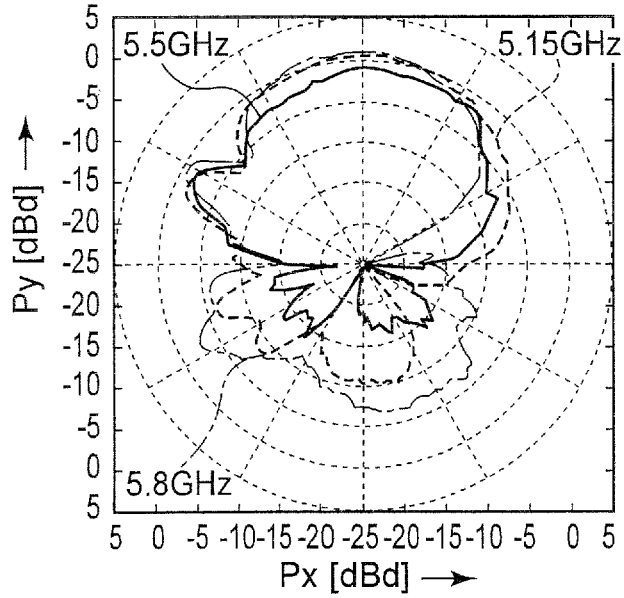
FIG. 15B is a graph showing a radiation pattern of the variable directivity antenna apparatus 1 when only the parasitic element 1*b* of FIG. 11A is turned on, where the radiation pattern showing experimental results of the prototype apparatus of the variable directivity antenna apparatus of the type B2 shown in FIGS. 11A and 11B.
Figure 15C:
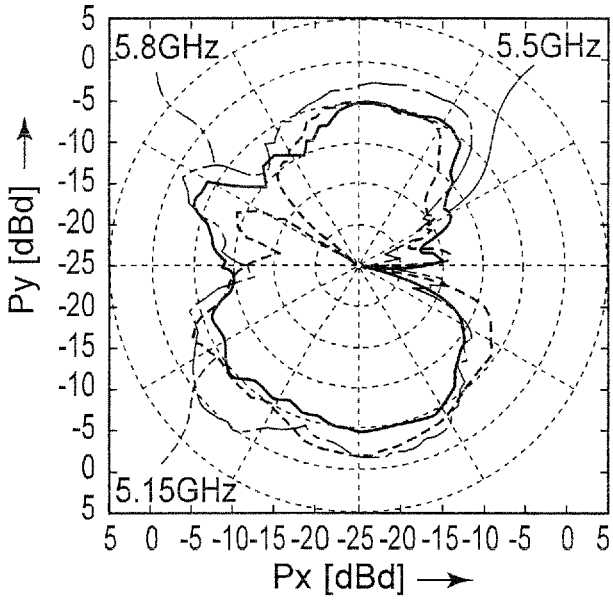
FIG. 15C is a graph showing a schematic radiation pattern of the variable directivity antenna apparatus 1 when only the parasitic element 1*a* of FIG. 11A is turned on, where the radiation pattern showing experimental results of the prototype apparatus of the variable directivity antenna apparatus of the type B2 shown in FIGS. 11A and 11B.
Figure 15D:
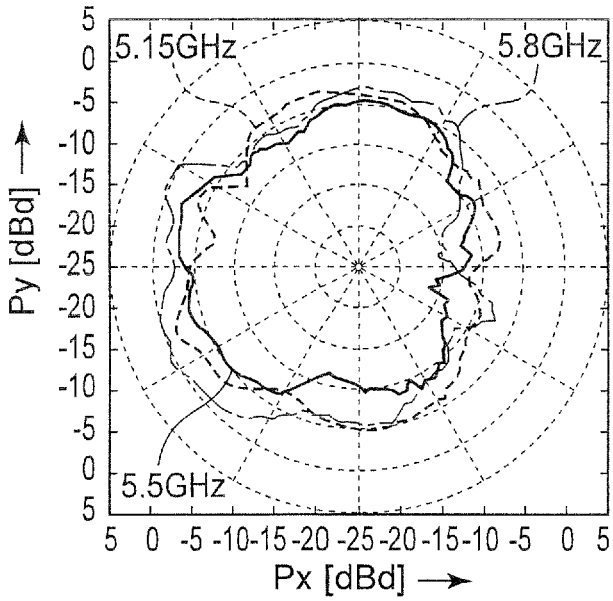
FIG. 15D is a graph showing a schematic radiation pattern of the variable directivity antenna apparatus 1 when the parasitic elements 1*a* and 1*b* of FIG. 11A are turned on, where the radiation pattern showing experimental results of the prototype apparatus of the variable directivity antenna apparatus of the type B2 shown in FIGS. 11A and 11B.

FIGS. 12A to FIG. 12D show the experimental results of the prototype apparatuses of the variable directivity antenna apparatus of the type A1 shown in FIGS. 8A and 8B. FIG. 12A is a graph showing a radiation pattern of the variable directivity antenna apparatus 1 when the parasitic elements 1*a* and 1*b* of FIG. 8A are turned off. FIG. 12B is a graph showing a radiation pattern of the variable directivity antenna apparatus 1 when only the parasitic element 1*b* of FIG. 8A is turned on. FIG. 12C is a graph showing a schematic radiation pattern of the variable directivity antenna apparatus 1 when only the parasitic element 1*a* of FIG. 8A is turned on. FIG. 12D is a graph showing a schematic radiation pattern of the variable directivity antenna apparatus 1 when the parasitic elements 1*a* and 1*b* of FIG. 8A are turned on. FIGS. 13A to 13D show the experimental results of the prototype apparatus of the variable directivity antenna apparatus of the type B1 shown in FIGS. 9A and 9B. FIG. 13A is a graph showing a radiation pattern of the variable directivity antenna apparatus 1 when the parasitic elements 1*a* and 1*b* of FIG. 9A are turned off. FIG. 13B is a graph showing a radiation pattern of the variable directivity antenna apparatus 1 when only the parasitic element 1*b* of FIG. 9A is turned on. FIG. 13C is a graph showing a schematic radiation pattern of the variable directivity antenna apparatus 1 when only the parasitic element 1*a* of FIG. 9A is turned on. FIG. 13D is a graph showing a schematic radiation pattern of the variable directivity antenna apparatus 1 when the parasitic elements 1*a* and 1*b* of FIG. 9A are turned on. Further, FIGS. 14A to 14D are the experimental results of the prototype apparatus of the variable directivity antenna apparatus of the type A2 shown in FIGS. 10A and 10B. FIG. 14A is a graph showing a radiation pattern of the variable directivity antenna apparatus 1 when the parasitic elements 1*a* and 1*b* of FIG. 10A are turned off. FIG. 14B is a graph showing a radiation pattern of the variable directivity antenna apparatus 1 when only the parasitic element 1*b* of FIG. 10A is turned on. FIG. 14C is a graph showing a schematic radiation pattern of the variable directivity antenna apparatus 1 when only the parasitic element 1*a* of FIG. 10A is turned on. FIG. 14D is a graph showing a schematic radiation pattern of the variable directivity antenna apparatus 1 when the parasitic elements 1*a* and 1*b* of FIG. 10A are turned on. Still further, FIGS. 15A to FIG. 15D show the experimental results of the prototype apparatus of the variable directivity antenna apparatus of the type 132 shown in FIGS. 11A and 11B. FIG. 15A is a graph showing a radiation pattern of the variable directivity antenna apparatus 1 when the parasitic elements 1*a* and 1*b* of FIG. 11A are turned off. FIG. 15B is a graph showing a radiation pattern of the variable directivity antenna apparatus 1 when only the parasitic element 1*b* of FIG. 11A is turned on. FIG. 15C is a graph showing a schematic radiation pattern of the variable directivity antenna apparatus 1 when only the parasitic element 1*a* of FIG. 11A is turned on. FIG. 15D is a graph showing a schematic radiation pattern of the variable directivity antenna apparatus 1 when the parasitic elements 1*a* and 1*b* of FIG. 11A are turned on. The experimental results of FIGS. 12A to 15D are considered below.

For simplicity of explanation, referring to FIGS. 12C, 13C, 14C and 15C, such a case is considered that only the parasitic element 1*a* is turned on. First of all, when the dual-band forming inductor 1*e* in the type B2 of FIG. 15 is formed in the meander shape to have the trapezoidal envelope external shape, the FB ratio is largely increased as a consequence of a reduction in the unwanted emission in the transverse direction in the 5-GHz band as shown in the type A1 of FIG. 12, however, it can be understood that the gain of the antenna apparatus is reduced. When the cut portions 1*ac*, 1*bc*, etc. are formed at the parasitic elements 1*a*, 1*b*, etc. in order to improve the gain, the gain of the antenna apparatus can be increased in the wide range of the 5-GHz band while a large value of the FB ratio is maintained as a consequence of the reduction in the unwanted emission in the transverse direction in the 5-GHz band as shown in the type B1 of FIG. 13C.

As described above, although it is difficult to changeover the directivity in the entire band since the use band has a wide range of about 800 MHz in the wireless LAN system of the 5-GHz band, the frequency characteristics of the antenna apparatus can be improved by forming the cut portions 1*ac* and 1*bc* so that the end portions of the parasitic elements 1*a* and 1*b* are formed in a stepped shape as shown in the type B1 of FIGS. 9A and 9B. With this configuration, the apparatus operates as a wide-band variable directivity antenna whose directivity can be satisfactorily changed over in each channel. In addition, the changeover of the directivity can achieve stable communications with avoiding of the null point without selection of the installation location.

In addition, although it is difficult to changeover of the directivity in the entire band since the use band has a wide range of about 800 MHz in the wireless LAN system of the 5-GHz band, the directivity can be made variable in the entire band of the 5-GHz band of the wide use frequency range by making the inductor 1*e* of the feed element 1*c* used for frequency separation of the 2.4-GHz and 5-GHz bands have a gradually widening shape as shown in the type A1 of FIGS. 8A and 8B and the type B1 of FIGS. 9A and 9B. In addition, the changeover of the directivity can achieve stable communications with avoiding of the null point without selection of the installation location.

In the preferred embodiment and the modified preferred embodiments described above, the wireless communication apparatus 300 is the wireless communication apparatus of the 2×2 MIMO transmission system conforming to the wireless LAN communication standard IEEE802.11n. However, the present invention is not limited to this. The wireless communication apparatus 300 may be a wireless communication apparatus conforming to another wireless communication standard of a portable telephone or the like.

Although the PIN diodes 501 to 504 are used in the preferred embodiment and the modified preferred embodiments described above, the present invention is not limited to this, but it is allowed to use another diode for use in a high frequency.

INDUSTRIAL APPLICABILITY

As described above in detail, according to the variable directivity antenna apparatus of the present invention, a cut portion having a rectangular shape is formed at a corner portion of another end of the parasitic element. Therefore, it is possible to provide a dual-band variable directivity antenna apparatus capable of securing a relatively higher antenna gain than that of the prior art, and securing a relatively larger FB ratio than that the prior art throughout a wide range at the higher frequency band.

REFERENCE SIGNS LIST

1 . . . variable directivity antenna apparatus,
1*a*, 1*b*, 1*ah*, and 1*bh* . . . parasitic element,
1*ahc* and 1*bhc* . . . cut portion,
1*c* . . . feed element,
1*d*, 1*f*, and 1*dh* . . . antenna element,
1*e* . . . dual-band forming inductor,
10 . . . apparatus controller,
11 . . . radiation pattern controller,
12 . . . wireless communication circuit,
13 . . . USB interface,
401 . . . antenna apparatus substrate,
404 and 404*g* . . . grounding conductor,
501 and 502 . . . PIN diode, and
511 and 512 . . . high-frequency blocking inductor.

The invention claimed is:

1. A variable directivity antenna apparatus comprising:

one feed element; and two parasitic elements provided to be aligned with each other, such that the feed element is interposed between the two parasitic elements and such that the two parasitic elements are electromagnetically close to the feed element, each parasitic element of the two parasitic elements having one end connected to one end of a respective diode having another end thereof grounded, wherein a directivity of the variable directivity antenna apparatus is changed by turning on and off the diodes connected to the two parasitic elements, wherein the feed element comprises:

a first antenna element having a first width;

a dual-band forming inductor; and a second antenna element having a second width wider than the first width, wherein the first antenna element, the dual-band forming inductor, and the second antenna element are connected in series with each other, wherein the dual-band forming inductor has a trapezoidal envelope external shape having an element width formed to widen starting from an element width identical with the first width at a portion of the dual-band forming inductor connected with the first antenna element and continuing to the second width of the second antenna element, and wherein each of the parasitic elements includes a cut portion having a rectangular shape, which is formed at a top corner portion thereof opposing to the dual-band forming inductor.

2. The variable directivity antenna apparatus as claimed in claim 1, wherein the second antenna element is formed to have the second width larger than a length in a longitudinal direction of the second antenna element.

* * * * *